US009905381B1

(12) United States Patent
Chen

(10) Patent No.: US 9,905,381 B1
(45) Date of Patent: Feb. 27, 2018

(54) LUMINOUS KEYBOARD

(71) Applicant: PRIMAX ELECTRONICS LTD., Taipei (TW)

(72) Inventor: Chung-Yuan Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 4 days.

(21) Appl. No.: 15/290,225

(22) Filed: Oct. 11, 2016

(30) Foreign Application Priority Data

Aug. 5, 2016 (TW) ..... 105124969 A

(51) Int. Cl.
*H01H 9/26* (2006.01)
*H01H 13/83* (2006.01)
*H01H 13/703* (2006.01)
*H01H 13/704* (2006.01)

(52) U.S. Cl.
CPC ..... *H01H 13/83* (2013.01); *H01H 13/703* (2013.01); *H01H 13/704* (2013.01)

(58) Field of Classification Search
CPC ..... H01H 13/00; H01H 13/12; H01H 13/02; H01H 13/14; H01H 13/20; H01H 13/26; H01H 13/70; H01H 13/703; H01H 13/705; H01H 13/704; H01H 13/83; H01H 2003/00; H01H 2003/02; H01H 2003/12; H01H 2009/16; H01H 2009/161; H01H 2009/182; H01H 2009/183; H01H 2009/184; H01H 2201/00; H01H 2219/00; H01H 2219/014; H01H 2219/018; H01H 2219/036; H01H 2219/037; H01H 2219/038; H01H 2219/039; H01H 2219/04; H01H 2219/044; H01H 2219/054; H01H 2219/056; H01H 2219/058; H01H 2219/06; H01H 2219/062; H01H 2219/0622; H01H 2219/064; H01H 2219/066
USPC ..... 200/310, 5 A, 5 R, 511–512, 520, 521, 200/308, 311, 313, 314, 317, 337, 341, 200/343, 345, 292, 329
See application file for complete search history.

(56) References Cited

U.S. PATENT DOCUMENTS 7,841,791 B2 * 11/2010 Iso ..... G06F 1/1616 400/472
2004/0174339 A1 * 9/2004 Liao ..... H01H 3/125 345/167
2009/0103964 A1 * 4/2009 Takagi ..... H01H 3/125 400/495

* cited by examiner

*Primary Examiner* — Anthony R. Jimenez
(74) *Attorney, Agent, or Firm* — Kirton McConkie; Evan R. Witt

(57) ABSTRACT

A luminous keyboard includes plural keys, a membrane switch circuit board and a light-emitting element. The membrane switch circuit board includes an upper wiring plate, a lower wiring plate, a conductor line pattern, a separation layer and an etched line pattern. The lower wiring plate includes a wiring plate opening. The conductor line pattern is arranged between the upper wiring plate and the lower wiring plate. The etched line pattern is arranged between the separation layer and the lower wiring plate. The etched line pattern is exposed through the wiring plate opening. The light-emitting element is electrically connected with the etched line pattern through the wiring plate opening in order to acquire electric power. Consequently, it is not necessary to install the illumination circuit board to provide the electric power to the light-emitting element.

10 Claims, 8 Drawing Sheets

LUMINOUS KEYBOARD

FIELD OF THE INVENTION

The present invention relates to a keyboard, and more particularly to a luminous keyboard with an illuminating function.

BACKGROUND OF THE INVENTION

Generally, the widely-used peripheral input device of a computer system includes for example a mouse device, a keyboard, a trackball device, or the like. Via the keyboard, characters and symbols can be inputted into the computer system directly. As a consequence, most users and most manufacturers of input devices pay much attention to the development of keyboards.

FIG. 1 is a schematic top view illustrating the outer appearance of a conventional keyboard. As shown in FIG. 1, there are plural keys 10 on a surface of the conventional keyboard 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard 1 is a keyboard for a notebook computer.

With the maturity of the computing technologies, the keyboard manufacturers make efforts in designing novel keyboards with special functions in order to meet diversified requirements of different users. For this reason, luminous keyboards are favored by users. The outer appearance of the conventional luminous keyboard is substantially similar to the outer appearance of the conventional keyboard 1. Since the luminous keyboard provides the function of illuminating the keys, the inner structure of the luminous keyboard is different from the inner structure of the keyboard without the illuminating function. Hereinafter, the inner structure of the luminous keyboard will be illustrated in more details. FIG. 2 is a schematic cross-sectional view illustrating a conventional luminous keyboard. As shown in FIG. 2, the conventional luminous keyboard 2 comprises plural keys 20, a membrane switch circuit board 21, a light guide plate 22, a backlight module 23, a base plate 24 and a reflecting plate 25. Each key 20 comprises a keycap 201, a scissors-type connecting element 202 and an elastic element 203. From top to bottom, the keycap 201, the scissors-type connecting element 202, the elastic element 203, the membrane switch circuit board 21, the base plate 24, the light guide plate 22 and the reflecting plate 25 of the conventional luminous keyboard 2 are sequentially shown. The backlight module 23 is located at a side of the membrane switch circuit board 21. For example, the conventional luminous keyboard 2 is a keyboard for a notebook computer (not shown).

In the key 20, the keycap 201 is exposed outside the conventional luminous keyboard 2, and thus the keycap 201 can be depressed by the user. The scissors-type connecting element 202 is used for connecting the keycap 201 and the base plate 24. The elastic element 203 is penetrated through the scissors-type connecting element 202. In addition, both ends of the elastic element 203 are contacted with the keycap

201 and the membrane switch circuit board 21, respectively. The membrane switch circuit board 21 comprises an upper wiring plate 211, a separation layer 212, and a lower wiring plate 213. The upper wiring plate 211, the separation layer 212 and the lower wiring plate 213 are all made of a light-transmissible material. The light-transmissible material is for example polycarbonate (PC) or polyethylene (PE). The upper wiring plate 211 comprises an upper printed circuit pattern 2111 with plural upper contacts 2112. The separation layer 212 is disposed under the upper wiring plate 211, and comprises plural perforations 2121 corresponding to the plural upper contacts 2112. The lower wiring plate 213 is disposed under the separation layer 212. Moreover, the lower wiring plate 213 comprises a lower printed circuit pattern 2131 with plural lower contacts 2132 corresponding to the plural upper contacts 2112. The plural lower contacts 2132 and the plural upper contacts 2112 are collectively defined as plural key switches 214.

The backlight module 23 comprises an illumination circuit board 231 and plural light-emitting elements 232. For clarification and brevity, only two light-emitting elements 232 are shown in the drawing. The illumination circuit board 231 is disposed under the membrane switch circuit board 21 and electrically connected with the light-emitting elements 232. The illumination circuit board 231 provides electric power to the plural light-emitting elements 232. The plural light-emitting elements 232 are disposed on the illumination circuit board 231. In addition, the plural light-emitting elements 232 are inserted into plural reflecting plate openings 251 of the reflecting plate 25 and plural light guide plate openings 221 of the light guide plate 22, respectively. By acquiring the electric power, the plural light-emitting elements 232 are driven to emit plural light beams B. Moreover, the plural light beams B are introduced into the light guide plate 22. For example, the plural light-emitting elements 232 are side-view light emitting diodes. The plural light beams B are subjected to total internal reflection within the light guide plate 22, and thus the plural light beams B are guided to the keycaps 201 by the light guide plate 22. As shown in FIG. 2, the base plate 24 is arranged between the membrane switch circuit board 21 and the light guide plate 22. The keycap 201, the scissors-type connecting element 202, the elastic element 203 and the membrane switch circuit board 21 are supported by the base plate 24. The reflecting plate 25 is disposed under the light guide plate 22 for reflecting the plural light beams B. Consequently, the plural light beams B are directed upwardly, and the utilization efficiency of the light beams B is enhanced.

In the conventional luminous keyboard 2, each keycap 201 has a light-outputting zone 2011. The light-outputting zone 2011 is located at a character region or a symbol region of the keycap 201. Moreover, the position of the light-outputting zone 2011 is aligned with the position of a corresponding light-guiding dot 223 of the light guide plate 22. The light beams B can be guided upwardly to the light-outputting zone 2011 by the corresponding light-guiding dot 223. The base plate 24 comprises plural base plate openings 241. The plural base plate openings 241 are aligned with corresponding light-guiding dots 223 and corresponding light-outputting zones 2011. On the other hand, since the membrane switch circuit board 21 is made of the light-transmissible material, the plural light beams B can be transmitted through the membrane switch circuit board 21. Consequently, after the plural light beams B are guided by the light-guiding dots 223, the plural light beams B are sequentially transmitted through the plural base plate openings 241 and the membrane switch circuit board 21 and directed to the plural light-outputting zones 2011, thereby illuminating the character regions or the symbol regions of the keycaps 201. Under this circumstance, the illuminating function is achieved.

However, the conventional luminous keyboard still has some drawbacks. For example, each of the upper printed circuit pattern 2111 and the lower printed circuit pattern 2131 of the membrane switch circuit board 21 is formed by printing plural silver conductor lines. As known, the resistance of silver is high. Moreover, the resistance tolerances of the upper printed circuit pattern 2111 and the lower printed circuit pattern 2131 are very large whenever the membrane switch circuit board 21 is produced. For example, the resistance tolerance is even up to several hundred ohms. For controlling the membrane switch circuit board 21 to generate the stable voltage, it is necessary to adjust the resistance value of the membrane switch circuit board 21 after the membrane switch circuit board 21 is produced. In other words, the use of the conventional membrane switch circuit board 21 increases the fabricating cost.

Therefore, there is a need of providing a luminous keyboard with reduced fabricating cost.

SUMMARY OF THE INVENTION

An object of the present invention provides a luminous keyboard with reduced fabricating cost.

In accordance with an aspect of the present invention, there is provided a luminous keyboard. The luminous keyboard includes plural keys, a membrane switch circuit board and a light-emitting element. The plural keys are exposed outside the luminous keyboard. The membrane switch circuit board is disposed under the plural keys. When the membrane switch circuit board is triggered by one of the plural keys, a corresponding key signal is generated. The membrane switch circuit board includes an upper wiring plate, a lower wiring plate, a conductor line pattern, a separation layer and an etched line pattern. The upper wiring plate is contacted with the plural keys. The lower wiring plate is disposed under the upper wiring plate and includes a wiring plate opening. The wiring plate opening runs through the lower wiring plate. The conductor line pattern is arranged between the upper wiring plate and the lower wiring plate. The separation layer is arranged between the upper wiring plate and the lower wiring plate. The upper wiring plate and the lower wiring plate are separated from each other by the separation layer. The etched line pattern is arranged between the separation layer and the lower wiring plate. The etched line pattern is exposed through the wiring plate opening. The light-emitting element is electrically connected with the etched line pattern through the wiring plate opening. The light-emitting element emits a light beam.

From the above descriptions, the present invention provides the luminous keyboard. The light-emitting element is installed on the membrane switch circuit board. Consequently, it is not necessary to install the illumination circuit board. Under this circumstance, the thickness of the luminous keyboard is reduced, and the luminous keyboard has the slim appearance. Moreover, the etched line pattern of the membrane switch circuit board can be used to replace a part or the entire of the printed conductor line layer. The etched line pattern is made of copper foil material. Since the resistance of copper is very stable, the problem of the conventional technology from the unstable resistance tolerances will be overcome. Moreover, the fabricating cost is reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional luminous keyboard, the present invention provides an improved luminous keyboard.

Figure 1:
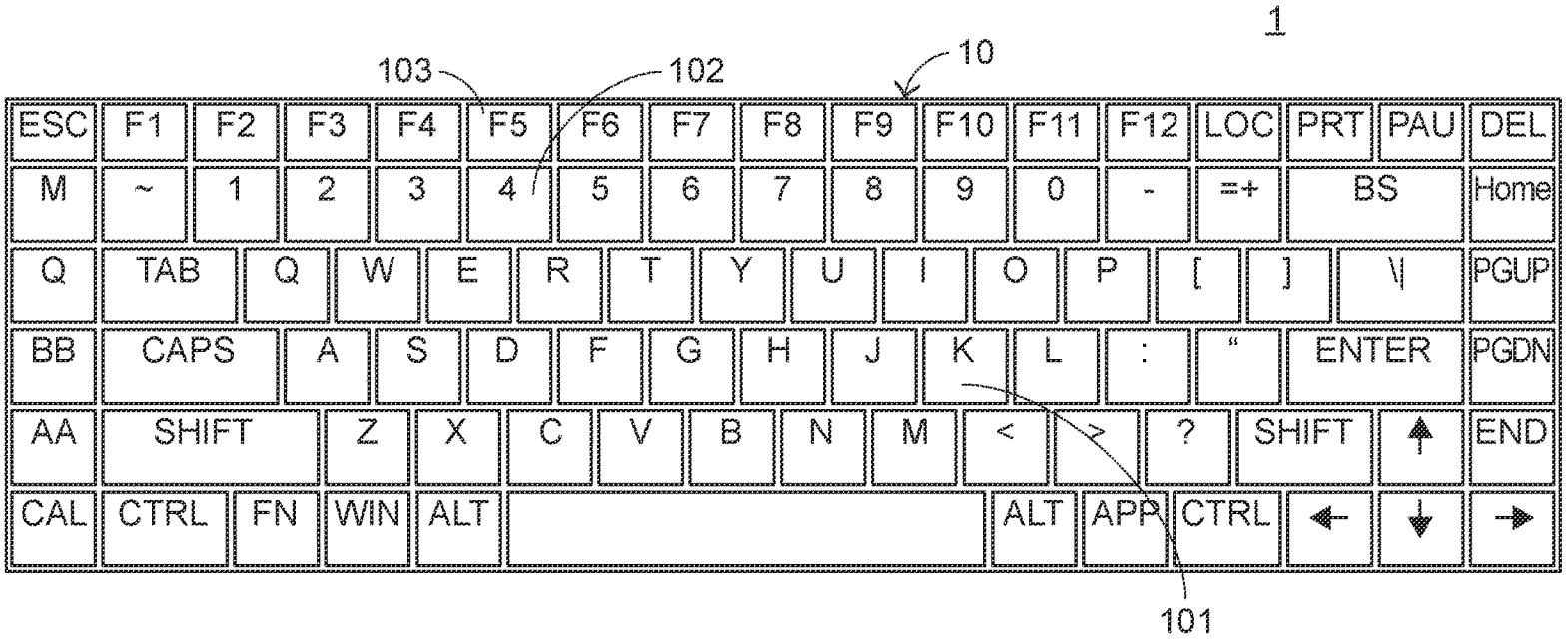
FIG.1 PRIOR ART
FIG. 1 is a schematic top view illustrating the outer appearance of a conventional keyboard.
Figure 2:
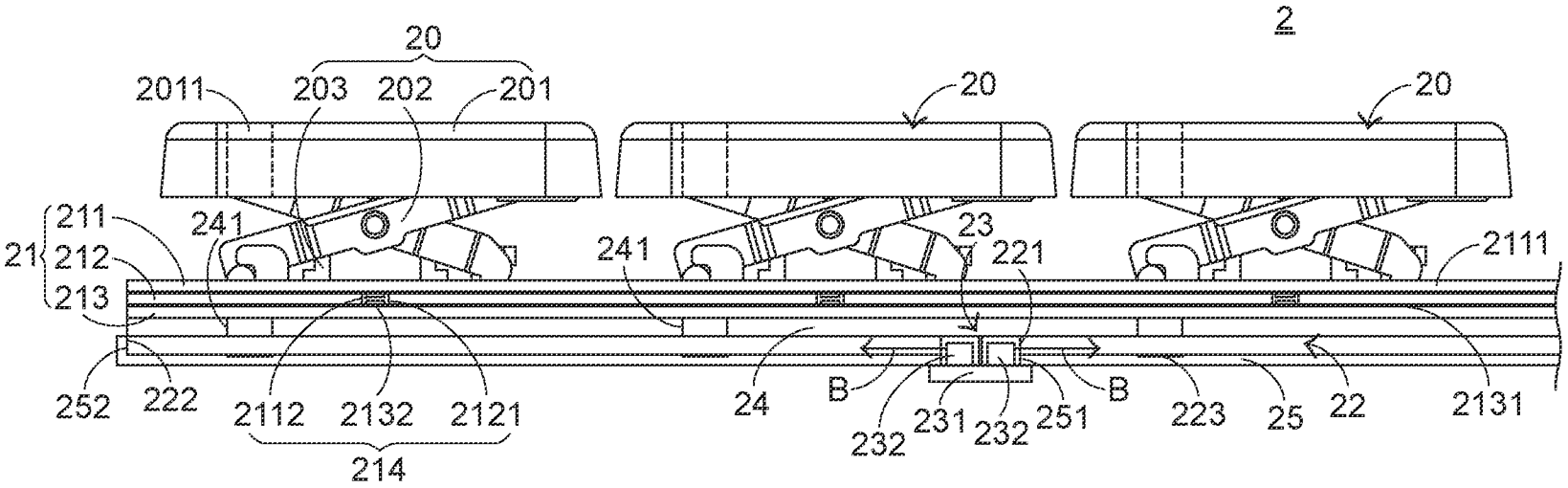
FIG. 2 PRIOR ART
FIG. 2 is a schematic cross-sectional view illustrating a conventional luminous keyboard.
Figure 3:
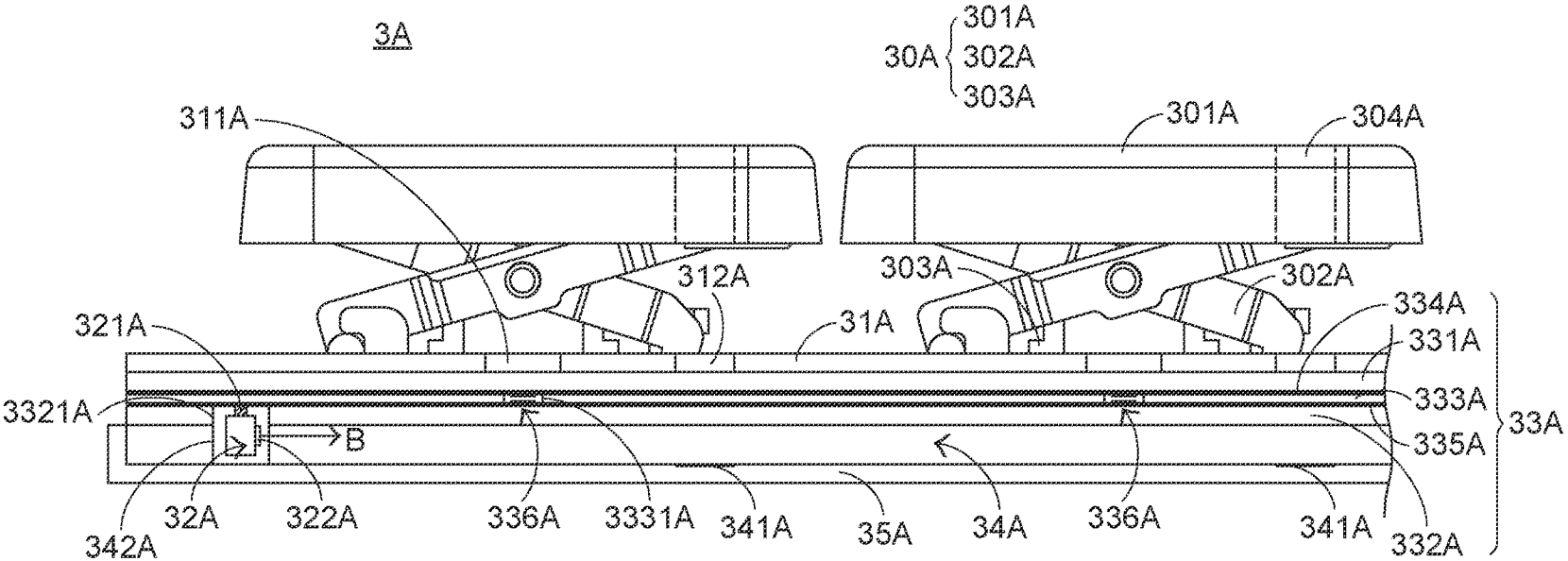
FIG. 3 is a schematic cross-sectional view illustrating the structure of a luminous keyboard according to a first embodiment of the present invention.

First of all, the structure of the luminous keyboard of the present invention will be illustrated as follows. FIG. 3 is a schematic cross-sectional view illustrating the structure of a luminous keyboard according to a first embodiment of the present invention. As shown in FIG. 3, the luminous keyboard 3A comprises plural keys 30A, a base plate 31A, at least one light-emitting element 32A, a membrane switch circuit board 33A, a light guide plate 34A and a reflecting plate 35A. The plural keys 30A are exposed outside a top surface of the luminous keyboard 3A. The membrane switch circuit board 33A is disposed under the plural keys 30A. When the membrane switch circuit board 33A is triggered by one of the plural keys 30A, a corresponding key signal is generated. The base plate 31A is arranged between the plural keys 30A and the membrane switch circuit board 33A, and connected with the plural keys 30A. Each of the plural keys 30A comprises a keycap 301A, a connecting element 302A and an elastic element 303A. Each keycap 301A has a light-outputting zone 304A. The plural keycaps 301A are exposed to the top surface of the luminous keyboard 3A, so that the keycaps 301A can be depressed by the user. The connecting elements 302A are used for connecting the corresponding keycaps 301A and the supporting plate 31A and allowing the keycaps 301A to be moved upwardly or downwardly relative to the supporting plate 31A. The elastic elements 303A are penetrated through the corresponding connecting elements 302A, and contacted with the corresponding keycaps 301A and the membrane switch circuit board 33A. The elastic element 303A provides an elastic force to the keycap 301A. In response to the elastic force, the keycap 301A is returned to its original position.

In this embodiment, the connecting element 302A is a scissors-type connecting element, and the elastic element 303A is a rubbery elastomer. Preferably but are not exclusively, the plural keycaps 301A of the plural keys are moved upwardly or downwardly with the connecting elements 302A, and the membrane switch circuit board 33A is depressed by the elastic elements 303A through the connecting elements 302A. In another embodiment, the connecting elements are non-scissors connecting elements for controlling movements of the keys. For example, a crater-shaped connecting element for a desktop computer is one of the non-scissors connecting elements. In a further embodiment, the keycaps are moved upwardly or downwardly in response to magnetic forces.

Please refer to FIG. 3 again. The light-emitting element 32A is disposed on the membrane switch circuit board 33A in an inverted form, and disposed under the plural keys 30A. The light-emitting element 32A is used for emitting a light beam B. The light guide plate 34A is disposed under the plural keys 30A, and located bedside the light-emitting element 32A. The light beam B from the light-emitting element 32A is laterally introduced into the light guide plate 34A and guided by the light guide plate 34A. Consequently, the light beam B is projected to the corresponding light-outputting zones 304A. In this embodiment, the light guide plate 34A comprises plural light-guiding structures 341A and at least one light guide plate opening 342A. Each light-guiding structure 341A is aligned with the corresponding light-outputting zone 304A. The light-guiding structures 341A are used for guiding the light beam B to the corresponding light-outputting zones 304A in order to illuminate the corresponding keys. The light guide plate opening 342A is aligned with the light-emitting element 32A. Moreover, the light-emitting element 32A is inserted into the light guide plate opening 342A. The reflecting plate 35A is disposed under the light guide plate 34A. Moreover, a portion of the light beam B exited from the light guide plate 34A is reflected by the reflecting plate 35A. Consequently, the leaked fraction of the light beam B is reduced, and the utilization efficiency of the light beam B is enhanced. In an embodiment, the light-emitting element 32A is a side-view light emitting diode, and each light-guiding structure 341A is one of a light-guiding microstructure, a light-guiding dot, a light-guiding ink and a light-guiding texturing structure.

Figure 4:
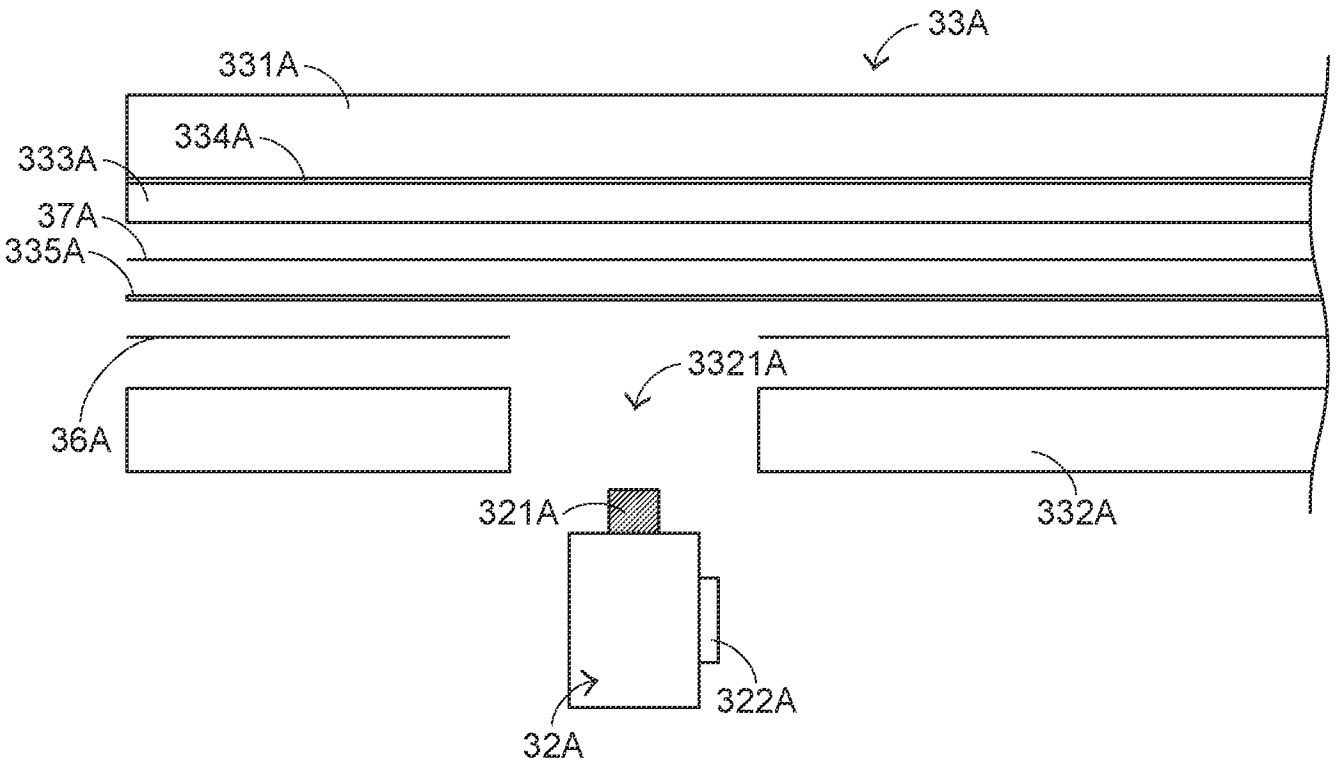
FIG. 4 is a schematic cross-sectional exploded view illustrating a portion of the luminous keyboard according to the first embodiment of the present invention.

FIG. 4 is a schematic cross-sectional exploded view illustrating a portion of the luminous keyboard according to the first embodiment of the present invention. Please refer to FIGS. 3 and 4. The membrane switch circuit board 33A comprises an upper wiring plate 331A, a lower wiring plate 332A, a separation layer 333A, a conductor line pattern 334A and an etched line pattern 335A. The upper wiring plate 331A is contacted with the elastic elements 303A. The conductor line pattern 334A is printed on a bottom surface of the upper wiring plate 331A. That is, the conductor line pattern 334A is a printed conductor line layer. The lower wiring plate 332A is disposed under the upper wiring plate 331A. Moreover, the lower wiring plate 332A comprises at least one wiring plate opening 3321A. The wiring plate opening 3321A runs through the lower wiring plate 332A. The separation layer 333A is arranged between the upper wiring plate 331A and the lower wiring plate 332A. When the key 30A is not depressed, the upper wiring plate 331A and the lower wiring plate 332A are separated from each other by the separation layer 333A. Moreover, the separation layer 333A comprises plural perforations 3331A corresponding to the plural keys 30A. The etched line pattern 335A is arranged between the separation layer 333A and the lower wiring plate 332A. Moreover, the wiring plate opening 3321A is sheltered by the etched line pattern 335A. Consequently, the etched line pattern 335A is exposed through the wiring plate opening 3321A of the lower wiring plate 332A. Moreover, the conductor line pattern 334A, the perforation 3331A and the etched line pattern 335A corresponding to one key 30A are collaboratively defined as a key switch 336A. In an embodiment, the conductor line pattern 334A is made of silver. Moreover, the etched line pattern 335A is formed by etching a copper foil layer. The way of forming the etched line pattern 335A is well known to those skilled in the art, and is not redundantly described herein.

The light-emitting element 32A is inserted into the wiring plate opening 3321A and electrically connected with the etched line pattern 335A. The light-emitting element 32A comprises a conducting part 321A and a light-outputting part 322A. The conducting part 321A is contacted with the etched line pattern 335A. Through the conducting part 321A, the light-emitting element 32A is electrically connected with the etched line pattern 335A to acquire electric power. The light beam B is outputted from the light-outputting part 322A. When the light-emitting element 32A is inserted into the wiring plate opening 3321A, the conducting part 321A is contacted with the etched line pattern 335A and the light-outputting part 322A is partially received in the wiring plate opening 3321A.

As shown in FIG. 4, the luminous keyboard 3A further comprises a first adhesive layer 36A and a second adhesive layer 37A. The first adhesive layer 36A is arranged between the etched line pattern 335A and the lower wiring plate 332A. The etched line pattern 335A is fixed on a top surface of the lower wiring plate 332A through the first adhesive layer 36A. The second adhesive layer 37A is arranged between the separation layer 333A and the etched line pattern 335A. The etched line pattern 335A and the lower wiring plate 332A are fixed on a bottom surface of the separation layer 333A through the second adhesive layer 37A. In this embodiment, the first adhesive layer 36A is a non-conductive adhesive layer. Moreover, the wiring plate opening 3321A of the lower wiring plate 332A is not sheltered by the first adhesive layer 36A. That is, the first adhesive layer 36A is not aligned with the wiring plate opening 3321A.

The following three aspects should be specially described. Firstly, the base plate 31A as shown in FIG. 3 comprises plural first base plate openings 311A and plural second base plate openings 312A. Each of the first base plate openings 311A is aligned with the corresponding key switch 336A. While one of the plural keycaps 301A is depressed by the user, a portion of the elastic element 303A under the keycap 301A is penetrated through the corresponding first base plate opening 311A and contacted with the upper wiring plate 331A. Each of the second base plate openings 312A is aligned with the light-outputting zones 304A of the corresponding keycap 301A. After the light beam B is transmitted through the second base plate opening 312A, the light beam B is projected to the light-outputting zones 304A.

Secondly, the light-outputting part 322A of the light-emitting element 32A is partially received in the wiring plate opening 3321A. Consequently, the light beam B from the light-outputting part 322A is easily introduced into the light guide plate 34A, and the light beam B is also easily projected to the lower wiring plate 332A. Under this circumstance, a light leakage problem possibly occurs. For avoiding the light leakage problem, at least one of the lower wiring plate 332A and the separation layer 333A is made of an opaque material. Consequently, the light beam B cannot be introduced into the lower wiring plate 332A or the separation layer 333A.

Thirdly, in the above embodiment, the wiring plate opening 3321A of the lower wiring plate 332A is not sheltered by the first adhesive layer 36A. Consequently, the conducting part 321A of the light-emitting element 32A can be contacted with the etched line pattern 335A. It is noted that numerous modifications and alterations may be made while retaining the teachings of the invention. For example, in another embodiment, the first adhesive layer is a conductive adhesive layer. Since the first adhesive layer is electrically conductive, the wiring plate openings of the lower wiring plate can be sheltered by the first adhesive layer. When the light-emitting element is inserted in the wiring plate opening, the conducting part is contacted with the etched line pattern.

The operating principles of depressing the keycaps 301A of the luminous keyboard 3A to generate the key signals are well known to those skilled in the art, and are not redundantly described herein.

Figure 5:
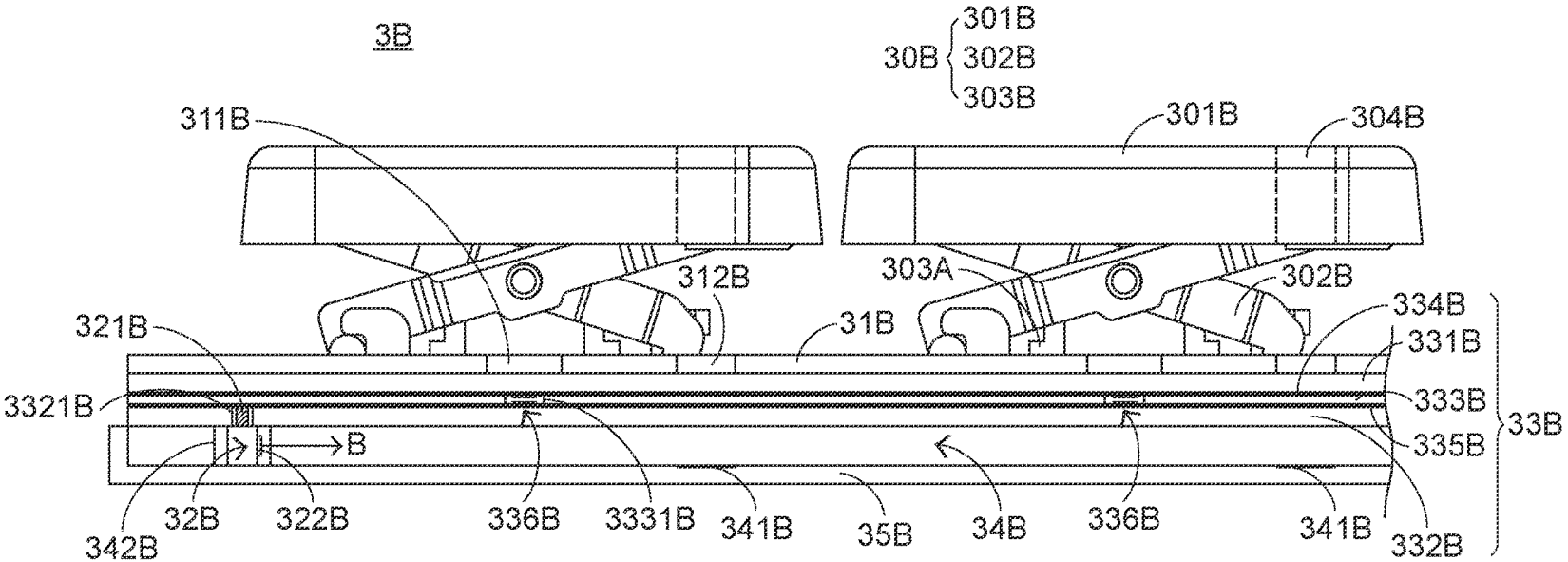
FIG. 5 is a schematic cross-sectional view illustrating the structure of a luminous keyboard according to a second embodiment of the present invention.
Figure 6:
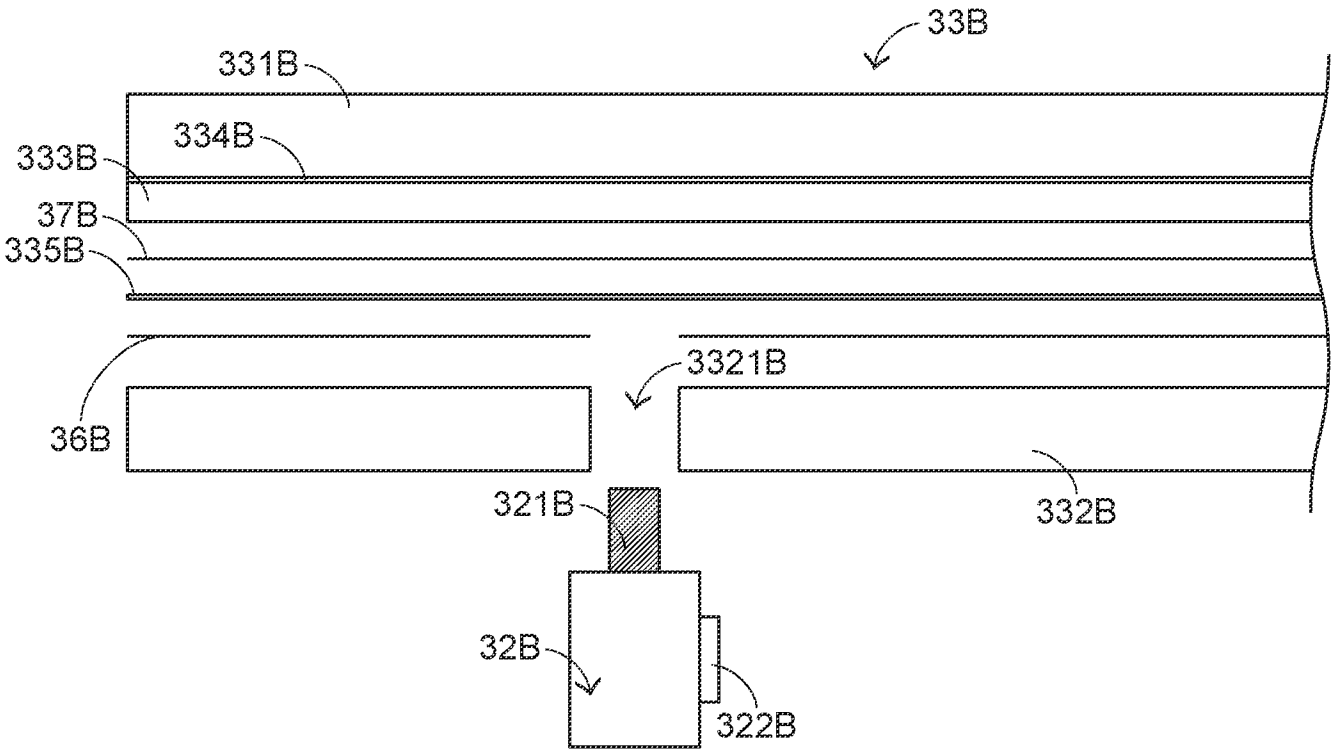
FIG. 6 is a schematic cross-sectional exploded view illustrating a portion of the luminous keyboard according to the second embodiment of the present invention.

The present invention further provides a luminous keyboard of a second embodiment, which is distinguished from the above embodiment. FIG. 5 is a schematic cross-sectional view illustrating the structure of a luminous keyboard according to a second embodiment of the present invention. FIG. 6 is a schematic cross-sectional exploded view illustrating a portion of the luminous keyboard according to the second embodiment of the present invention. As shown in FIGS. 5 and 6, the luminous keyboard 3B comprises plural keys 30B, a base plate 31B, at least one light-emitting element 32B, a membrane switch circuit board 33B, a light guide plate 34B, a reflecting plate 35B, a first adhesive layer 36B and a second adhesive layer 37B. Each of the plural keys 30B comprises a keycap 301B, a connecting element 302B and an elastic element 303B. Each keycap 301B has a light-outputting zone 304B. The light guide plate 34B comprises plural light-guiding structures 341B and at least one light guide plate opening 342B. Each light-guiding structure 341B is aligned with the corresponding light-outputting zone 304B. The membrane switch circuit board 33B comprises an upper wiring plate 331B, a lower wiring plate 332B, a separation layer 333B, a conductor line pattern 334B and an etched line pattern 335B. The lower wiring plate 332B comprises plural wiring plate openings 3321B. Moreover, the separation layer 333B comprises plural perforations 3331B corresponding to the plural keys 30B. In comparison with the first embodiment, the arrangement of the light-emitting element 32B of this embodiment is distinguished. The structures of the other components are similar to those of the first embodiment, and are not redundantly described herein.

Figure 7:
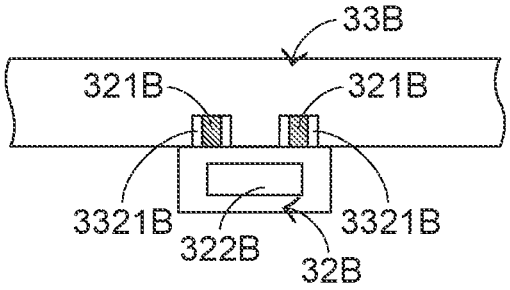
FIG. 7 is a schematic cross-sectional view illustrating the light-emitting element and the membrane switch circuit board of the luminous keyboard according to the second embodiment of the present invention.
Figure 8:
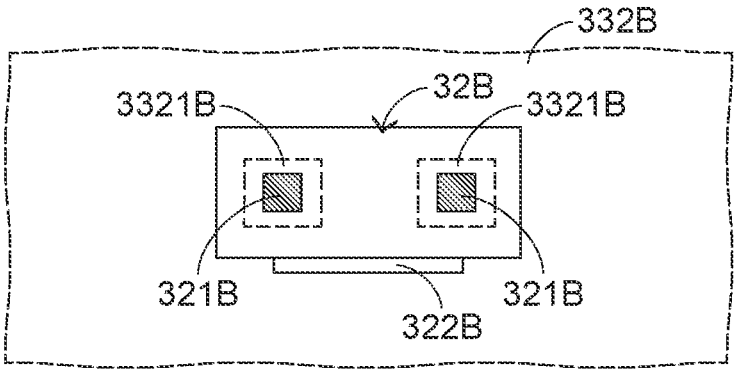
FIG. 8 is a schematic top view illustrating the light-emitting element and the lower wiring plate of the luminous keyboard according to the second embodiment of the present invention.

Please refer to FIGS. 5, 6, 7 and 8. FIG. 7 is a schematic cross-sectional view illustrating the light-emitting element and the membrane switch circuit board of the luminous keyboard according to the second embodiment of the present invention. FIG. 8 is a schematic top view illustrating the light-emitting element and the lower wiring plate of the luminous keyboard according to the second embodiment of the present invention. As shown in FIGS. 5 and 6, the light-emitting element 32B is disposed on the membrane switch circuit board 33B in an inverted form, and disposed under the plural keys 30B. The light-emitting element 32B comprises plural conducting parts 321B and a light-outputting part 322B. Each conducting part 321B is aligned with one corresponding wiring plate opening 3321B. The conducting parts 321B are contacted with the etched line pattern 335B. Through the conducting parts 321B, the light-emitting element 32B is electrically connected with the etched line pattern 335B to acquire electric power. The light beam B is outputted from the light-outputting part 322B. The conducting parts 321B of the light-emitting element 32B are inserted in the corresponding wiring plate opening 3321B and contacted with the etched line pattern 335B. Moreover, as shown in FIGS. 7 and 8, the light-outputting part 322B is not partially overlapped with the lower wiring plate 332B. Since the light beam B from the light-outputting part 322B is not introduced into the lower wiring plate 332B and the separation layer 333B, the light leakage problem is avoided. Under this circumstance, the lower wiring plate 332B and the separation layer 333Bare not made of the opaque material, and the light leakage problem is avoided.

Figure 9:
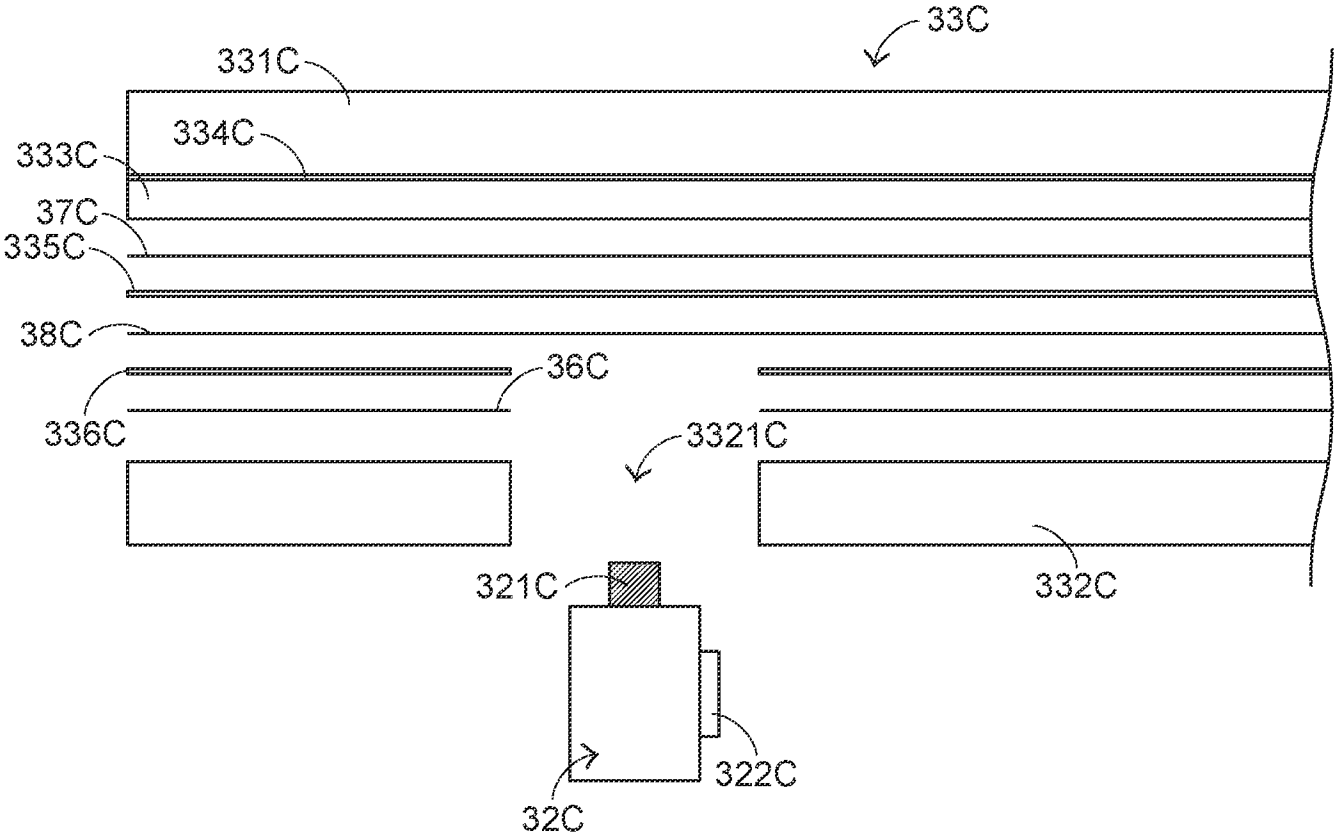
FIG. 9 is a schematic cross-sectional exploded view illustrating a portion of a luminous keyboard according to a third embodiment of the present invention.

The present invention further provides a luminous keyboard of a third embodiment, which is distinguished from the above embodiments. FIG. 9 is a schematic cross-sectional exploded view illustrating a portion of a luminous keyboard according to a third embodiment of the present invention. Except for the following two items, the structures of the other components of the luminous keyboard 3C of this embodiment are similar to those of the luminous keyboard 3A of the first embodiment, and are not redundantly described herein. In comparison with the first embodiment, the membrane switch circuit board 33C is distinguished. As shown in FIG. 9, the membrane switch circuit board 33C comprises an upper wiring plate 331C, a lower wiring plate 332C, a separation layer 333C, a conductor line pattern 334C, a first etched line pattern 335C and a second etched line pattern 336C. The conductor line pattern 334C is printed on a bottom surface of the upper wiring plate 331C. The lower wiring plate 332C is disposed under the upper wiring plate 331C. Moreover, the lower wiring plate 332C comprises at least one wiring plate opening 3321C. The wiring plate opening 3321C runs through the lower wiring plate 332C. The separation layer 333C is arranged between the upper wiring plate 331C and the lower wiring plate 332C. When the key 30C is not depressed, the upper wiring plate 331C and the lower wiring plate 332C are separated from each other by the separation layer 333C. Moreover, the separation layer 333C comprises plural perforations 3331C corresponding to the plural keys 30C.

The first etched line pattern 335C is arranged between the separation layer 333C and the lower wiring plate 332C. Moreover, the first etched line pattern 335C is aligned with the wiring plate opening 3321C, and the wiring plate opening 3321C is sheltered by the first etched line pattern 335C. Moreover, the conductor line pattern 334 and the first etched line pattern 335C corresponding to one key 30C are collaboratively defined as a key switch (not shown). The second etched line pattern 336C is arranged between the lower wiring plate 332C and the first etched line pattern 335C. Moreover, the wiring plate opening 3321C is not sheltered by the second etched line pattern 336C. Moreover, the circuitry layout of the second etched line pattern 336C is not aligned with the circuitry layout of the first etched line pattern 335C.

As shown in FIG. 9, the luminous keyboard 3C further comprises a first adhesive layer 36C, a second adhesive layer 37C and a third adhesive layer 38C. The first adhesive layer 36C is arranged between the second etched line pattern 336C and the lower wiring plate 332C. The second etched line pattern 336C is fixed on a top surface of the lower wiring plate 332C through the first adhesive layer 36C. The second adhesive layer 37C is arranged between the separation layer 333C and the first etched line pattern 335C. The first etched line pattern 335C is fixed on a bottom surface of the separation layer 333C through the second adhesive layer 37C. The third adhesive layer 38C is arranged between the first etched line pattern 335C and the second etched line pattern 336C. The first etched line pattern 335C and the second etched line pattern 336C are combined together through the third adhesive layer 38C. As shown in FIG. 9, the membrane switch circuit board 33C is further equipped with the second etched line pattern 336C in order to increase the functionality of the membrane switch circuit board 33C. For example, the second etched line pattern 336C is electrically connected to an antenna (not shown) in order to transmit electric power to the antenna.

Moreover, the light-emitting element 32C is penetrated through the wiring plate opening 3321C, the first adhesive layer 36C, the second etched line pattern 336C and the third adhesive layer 38C, and the conducting part 321C of the light-emitting element 32C is contacted with the etched line pattern 335C. Through the conducting part 321C, the light-emitting element 32C is electrically connected with the first etched line pattern 335C. Since the second etched line pattern 336C and the third adhesive layer 38C are not aligned with the wiring plate opening 3321C, the electric connection between the second adhesive layer 37C and the first etched line pattern 335C is not hindered. In this embodiment, the second adhesive layer 37C is a conductive adhesive layer. Consequently, the light-emitting element 32C can acquire the electric power through the first etched line pattern 335C.

Preferably but not exclusively, the conductor line pattern is a printed conductor line layer. In another embodiment, the conductor line pattern is also an etched line pattern. The conductor line pattern, the perforation and the etched line pattern are collaboratively defined as a key switch. Since the conductive wires of the key switch are all etched line patterns, the stability of the key switch is enhanced. Moreover, the conductive wires of the key switch can provide any other appropriate function (e.g., the function of connecting to the antenna).

From the above descriptions, the present invention provides the luminous keyboard. The light-emitting element is installed on the membrane switch circuit board. Consequently, it is not necessary to install the illumination circuit board. Under this circumstance, the thickness of the luminous keyboard is reduced, and the luminous keyboard has the slim appearance. Moreover, the etched line pattern of the membrane switch circuit board can be used to replace a part or the entire of the printed conductor line layer. The etched line pattern is made of copper foil material. Since the resistance of copper is very stable, it is necessary to adjust the resistance value of the membrane switch circuit board during the process of fabricating the luminous keyboard.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all modifications and similar structures.

What is claimed is:

1. A luminous keyboard, comprising:

plural keys exposed outside the luminous keyboard;

a membrane switch circuit board disposed under the plural keys, wherein when the membrane switch circuit board is triggered by one of the plural keys, a corresponding key signal is generated, wherein the membrane switch circuit board comprises:

an upper wiring plate contacted with the plural keys;

a lower wiring plate disposed under the upper wiring plate and comprising a wiring plate opening, wherein the wiring plate opening runs through the lower wiring plate;

a conductor line pattern arranged between the upper wiring plate and the lower wiring plate;

a separation layer arranged between the upper wiring plate and the lower wiring plate, wherein the upper wiring plate and the lower wiring plate are separated from each other by the separation layer; and an etched line pattern arranged between the separation layer and the lower wiring plate, wherein the etched line pattern is exposed through the wiring plate opening; and a light-emitting element electrically connected with the etched line pattern through the wiring plate opening, wherein the light-emitting element emits a light beam.

2. The luminous keyboard according to claim 1, wherein the light-emitting element comprises:

a conducting part contacted with the etched line pattern, wherein the light-emitting element is electrically connected with the etched line pattern through the conducting part; and a light-outputting part emitting the light beam, wherein the conducting part is inserted in the wiring plate opening and contacted with the etched line pattern, and the wiring plate opening is sheltered by the light-emitting element.

3. The luminous keyboard according to claim 1, further comprising:

an additional etched line pattern arranged between the lower wiring plate and the etched line pattern, wherein the wiring plate opening is not sheltered by the additional etched line pattern;

a first adhesive layer arranged between the additional etched line pattern and the lower wiring plate, wherein the additional etched line pattern is fixed on a top surface of the lower wiring plate through the first adhesive layer;

a second adhesive layer arranged between the separation layer and the etched line pattern, wherein the etched line pattern is fixed on a bottom surface of the separation layer through the second adhesive layer; and a third adhesive layer arranged between the etched line pattern and the additional etched line pattern, wherein the etched line pattern and the additional etched line pattern are combined together through the third adhesive layer.

4. The luminous keyboard according to claim 1, wherein the etched line pattern and the conductor line pattern are collaboratively defined as a key switch, the etched line pattern is formed by etching a copper foil layer, and the conductor line pattern is printed on a bottom surface of the upper wiring plate.

5. The luminous keyboard according to claim 1, wherein the etched line pattern and the conductor line pattern are collaboratively defined as a key switch, and each of the etched line pattern and the conductor line pattern is formed by etching a copper foil layer.

6. The luminous keyboard according to claim 1, wherein the light-emitting element comprises:

a conducting part contacted with the etched line pattern, wherein the light-emitting element is electrically connected with the etched line pattern through the conducting part; and a light-outputting part emitting the light beam, wherein the light-emitting element is inserted in the wiring plate opening, the conducting part is contacted with the etched line pattern, and the light-outputting part is partially received in the wiring plate opening.

7. The luminous keyboard according to claim 6, wherein at least one of the lower wiring plate and the separation layer is made of an opaque material, so that the light beam is not introduced into the lower wiring plate and the separation layer.

8. The luminous keyboard according to claim 1, further comprising:

a first adhesive layer arranged between the etched line pattern and the lower wiring plate, wherein the etched line pattern is fixed on a top surface of the lower wiring plate through the first adhesive layer; and a second adhesive layer arranged between the separation layer and the etched line pattern, wherein the etched line pattern is fixed on a bottom surface of the separation layer through the second adhesive layer.

9. The luminous keyboard according to claim 8, wherein the first adhesive layer is a non-conductive adhesive layer, and the wiring plate opening is not sheltered by the first adhesive layer.

10. The luminous keyboard according to claim 8, wherein the first adhesive layer is a conductive adhesive layer, and the wiring plate opening is sheltered by the first adhesive layer.

* * * * *